US008523483B2

(12) United States Patent
Nedwed et al.

(10) Patent No.: US 8,523,483 B2
(45) Date of Patent: Sep. 3, 2013

(54) ICE BREAK-UP USING ARTIFICIALLY GENERATED WAVES

(75) Inventors: Timothy J. Nedwed, Houston, TX (US); Robert D. Kaminsky, Houston, TX (US); Terrance D. Ralston, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 200 days.

(21) Appl. No.: 12/981,155

(22) Filed: Dec. 29, 2010

(65) Prior Publication Data

US 2011/0188938 A1 Aug. 4, 2011

Related U.S. Application Data

(60) Provisional application No. 61/301,076, filed on Feb. 3, 2010.

(51) Int. Cl.
*B63B 35/08* (2006.01)

(52) U.S. Cl.
USPC ..... 405/61; 405/76; 405/79; 114/40; 114/121

(58) Field of Classification Search
USPC ..... 405/211, 217, 61, 79; 114/40, 41
See application file for complete search history.

(56) References Cited

U.S. PATENT DOCUMENTS

| | | | |
|---|---|---|---|
| 1,150,311 | A | 8/1915 | Sperry |
| 3,477,233 | A | 11/1969 | Andersen |
| 4,048,943 | A | 9/1977 | Gerwick, Jr. |
| 4,102,288 | A | 7/1978 | Berry et al. |
| 4,201,496 | A | 5/1980 | Andersen |
| 4,507,018 | A | 3/1985 | Andersen |
| 4,578,000 | A | 3/1986 | Lindqvist et al. |
| 4,705,428 | A | 11/1987 | Andersen |
| 5,432,757 | A | 7/1995 | Chelminski |
| 7,270,066 | B2 | 9/2007 | Kulikov et al. |

(Continued)

FOREIGN PATENT DOCUMENTS

| | | | |
|---|---|---|---|
| CN | 1103624 | * | 6/1994 |
| FR | 2 528 466 | A1 | 12/1983 |

(Continued)

OTHER PUBLICATIONS

Moran, K., Backman, J., Farrel J.W., 2006."Deepwater drilling in the Artic Ocean's permanent sea ice". In Bachman, J., Moran, K., McInroy, D.B., Mayer, L.A., and the Expedition 302 Scientists, Prc. IODP, 302: Edinburgh (Integrated Ocean Drilling Program Management International, Inc.). doi: 10.2202/iodp.proc.302.106.2006.*

(Continued)

*Primary Examiner* — John Kreck
*Assistant Examiner* — Carib Oquendo
(74) *Attorney, Agent, or Firm* — ExxonMobil Upstream Research Company-Law Department

(57) ABSTRACT

A system and method for clearing an approaching floating ice mass comprising locating a hydrocarbon development platform in a marine environment, and determining a direction from which the ice mass is approaching the hydrocarbon development platform. The method also includes providing an intervention vessel having a water-agitating mechanism associated therewith for propagating artificially generated waves towards a leading edge of the approaching ice mass to fracture the ice mass along the leading edge, thereby causing small ice pieces to separate from the ice mass.

11 Claims, 8 Drawing Sheets

(56) References Cited

U.S. PATENT DOCUMENTS

| | | | |
|---|---|---|---|
| 7,458,329 | B2 | 12/2008 | Nedwed |
| 2008/0267716 | A1 | 10/2008 | D'Souza et al. |
| 2010/0126401 | A1 | 5/2010 | Kokkinis |

FOREIGN PATENT DOCUMENTS

| | | | |
|---|---|---|---|
| RU | 2 143 372 | C1 | 12/1999 |
| RU | 2 165 373 | C1 | 4/2001 |
| RU | 2 180 303 | C2 | 3/2002 |
| RU | 2 250 956 | C1 | 4/2005 |
| RU | 2 255 176 | C1 | 6/2005 |
| RU | 2 277 494 | C1 | 6/2006 |
| SU | 1217718 | A | 3/1986 |
| WO | WO 2008/048164 | A1 | 4/2008 |

OTHER PUBLICATIONS

Hibernia Ice Management, Dec. 30, 2008, www.hibernia.ca, 2 pages.
Machine language English translation of CN 1133808, 4 pages.
European Search Report, Aug. 25, 2010, 2 pages.

* cited by examiner

ICE BREAK-UP USING ARTIFICIALLY GENERATED WAVES

CROSS REFERENCE TO RELATED APPLICATIONS

This application claims the benefit of U.S. Provisional Application No. 61/301,076 filed Feb. 3, 2010.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present invention relates to the field of offshore operations in Arctic conditions. More specifically, the present invention relates to the break-up of ice masses in Arctic waters to prevent a collision of such ice masses with an offshore operations facility.

GENERAL DISCUSSION OF TECHNOLOGY

As the world's demand for fossil fuels increases, energy companies find themselves pursuing hydrocarbon resources in more remote areas of the world. Such pursuits sometimes take place in harsh, offshore conditions such as the North Sea. In recent years, drilling and production activities have been commenced in deepwater Arctic locations. Such areas include the Sea of Okhotsk at Sakhalin Island, as well as the U.S. and Canadian Beaufort Seas.

Because of the cold ambient temperatures, marine bodies in Arctic areas are frozen over during much of the year. Therefore, exploration and production operations in Arctic areas primarily take place in the summer months. Even during summer months (and the weeks immediately before and after when operations may be extended), the waters are prone to experiencing floating ice masses. Floating ice masses create hazards for equipment, support vessels, and even personnel.

Due to the presence of floating ice masses, it is desirable during oil and gas exploration, development, and production operations to employ ice management systems. The ice management systems would be used to reduce the ice impact loads on floating equipment. One method of ice management involves the use of ice breaking vessels to actively break large ice floes into smaller pieces. Of course, technology is already in use for mechanically breaking ice by direct contact with a ship hull. Breaking ice is generally not a case of cutting through the ice by forcing the vessel into an ice mass; rather, ice breaking occurs by the ice-strengthened ship riding up and over an ice mass, with the weight of the ship then breaking the ice. This technology is widely practiced outside the context of oil and gas exploration and production activities, such as for keeping shipping lanes open.

In the context of hydrocarbon development activities within an Arctic region, an ice breaking vessel has been considered for breaking large ice masses into smaller ice pieces. The smaller ice pieces may then be moved out of the path of floating equipment. Where the floating ice pieces are very small, such pieces will have only a small impact load that can readily be handled by floating equipment. Alternatively, they may be pushed aside using a tug boat or further broken by a second icebreaker. Such an active ice management method has been successfully implemented to extend the operating season somewhat beyond the summer ice-free period for seasonal production operations in the Sea of Okhotsk at Sakhalin Island as well as for exploratory drilling in the U.S. and Canadian Beaufort Sea.

Another technique for managing ice floes involves the use of dual ice breakers. Applicant is aware of an arctic coring expedition that was conducted near the North Pole in the summer of 2004. This was reported by K. Moran, J. Backman and J. W. Farrell, "Deepwater Drilling in the Arctic Ocean's Permanent Sea Ice," *Proceedings of the Integrated Ocean Drilling Program*, Volume 302, 2006). For this operation, two icebreakers were stationed updrift of a stationary seafloor coring vessel. The first ice breaker reportedly traveled in a circular pattern to reduce the size of large ice floes to pieces that were a maximum of 100 to 200 meters wide. The second icebreaker then broke the large ice pieces to produce smaller ice masses that were up to 20 meters wide. In this program, the coring vessel was able to maintain location for as long as nine consecutive days despite the presence of the broken ice pieces.

The use of active ice breaking vessels to protect floating equipment in the Arctic has several drawbacks. First, it requires maintaining at least one very robust ice breaking vessel, and preferably two. Second, where a second ice breaking vessel is used, the second ice breaking vessel may be unrealistically required to make tight circles or to maintain a position in direct coordination with the first ice breaker. Where only one ice breaking vessel is used, that vessel must not only break the large ice masses into smaller pieces, but it may also be called into duty to shepherd smaller pieces around floating equipment. In some cases, such as when a sudden change in floe direction takes place or when more than one large ice piece is approaching floating equipment simultaneously, this second responsibility may not be realistic, resulting in a need for a second icebreaker boat to prevent exposure of the floating vessel to a significant risk of collision with ice.

An improved method is needed for breaking up an ice mass approaching a floating operations vessel in Arctic waters. A system and improved method are also needed for clearing a floating ice mass as it approaches a hydrocarbon development platform such as a drill ship.

SUMMARY OF THE INVENTION

The methods described herein have various benefits in the conducting of oil and gas exploration and production activities in Arctic regions. First, a method is provided for clearing an approaching floating ice mass. The method, in one embodiment, includes the step of locating a hydrocarbon development platform in a marine environment. The hydrocarbon development platform may be, for example, a drill ship or a ship-shaped production platform. Alternatively, the hydrocarbon development platform may be, for example, a non-ship-shaped workover platform, a floating production, storage and offloading ("FPSO") vessel, or an oceanographic survey vessel. Other types of vessels include a construction vessel as may be used to install subsea equipment or to lay pipe, a subsea cable installation vessel, a diver support vessel, an oil spill response vessel, or a submarine rescue vessel.

The marine environment comprises a large body of water. The body of water includes a water surface. The marine environment may be a bay, a sea, or an ocean in the Arctic region of the earth. The hydrocarbon development platform is optionally maintained at its location in the marine environment by a dynamic positioning system. Alternatively, a mooring system may be employed.

The method further includes providing an intervention vessel. The intervention vessel is preferably a ship-shaped vessel having a deck and a hull. Preferably, the intervention vessel is equipped with ice-breaking capability.

The intervention vessel has a water-agitating mechanism carried thereon. Various types of water-agitating mechanisms may be employed. For example, the water-agitating mechanism may comprise a gyroscopic system attached within the hull of the intervention vessel. The gyroscopic system may comprise a large spinning mass, a controller, and at least one gear for moving the large spinning mass so as to cause forced precession. The controller reciprocates the large spinning mass according to a specified frequency and amplitude. The large spinning mass is reciprocated in a direction to cause the intervention vessel to pitch, to roll, or combinations thereof. This movement of the intervention vessel, in turn, creates ice-breaking waves.

In another embodiment, the water-agitating mechanism comprises a plurality of air guns. The air guns are disposed below the surface of the marine environment in the body of water. The plurality of air guns may be fired substantially simultaneously at a frequency of about two seconds to five seconds (0.5 Hz to 0.2 Hz).

In another embodiment, the water-agitating mechanism comprises a plurality of paddles. The paddles rotate through the surface of the marine environment and into the body of water. The plurality of paddles may rotate substantially simultaneously at a frequency of about three to five seconds (0.33 Hz to 0.2 Hz).

In another embodiment, the water-agitating mechanism comprises at least one pair of offsetting propulsion motors. The propulsion motors operate below the surface of the marine environment and in the body of water. In one aspect, the at least one pair of offsetting propulsion motors are intermittently started and stopped in cycles to create waves having well-defined peaks and troughs. The cycles may be, for example, every two to ten seconds (0.5 Hz to 0.1 Hz).

In still another embodiment, the water-agitating mechanism comprises a plurality of plungers that reciprocate vertically in the body of water. In one aspect, the plurality of plungers reciprocate substantially simultaneously.

In one arrangement, the plurality of plungers may reciprocate according to a stroke that is about 5 to 20 feet. In this instance, the frequency of the strokes may be about every three to ten seconds (0.33 Hz to 0.1 Hz). Here, the top of the stroke is above the surface of the body of water, while the bottom of the stroke is below the surface of the body of water.

In another arrangement, the plurality of plungers may reciprocate according to a stroke that is about 1 to 5 feet. This is a much shorter stroke such that the plunger is in the nature of a resonance vibrator. In this instance, the frequency of the strokes is about 0.1 to 2.0 seconds (10.0 Hz to 0.5 Hz). Here, both the top and the bottom of each stroke is below the surface of the body of water.

The method for clearing an approaching floating ice mass also includes determining a direction from which the ice mass is approaching the hydrocarbon development platform. The method then includes positioning the intervention vessel generally between the hydrocarbon development platform and the approaching ice mass.

The method also includes actuating the water-agitating mechanism in order to propagate artificially generated waves. The waves travel towards a leading edge of the approaching ice mass. In one aspect, the artificially generated waves have an amplitude of about two feet to five feet.

The method also includes continuing to operate the water-agitating mechanism so as to fracture the ice mass along the leading edge. This causes small ice pieces to separate from the ice mass. The small ice pieces then float in the marine environment, with some tending to float towards the hydrocarbon development platform.

The method may optionally include continuing to further operate the water-agitating mechanism. This is for the purpose of clearing at least some of the small ice pieces from the hydrocarbon development platform. This results in a substantially ice-free zone downstream of the intervention vessel. This, in turn, allows the hydrocarbon development platform to operate without worry of ice mass collisions. As an alternative, or in addition, the hydrocarbon development platform is engineered to withstand the load caused by any impact with the small ice pieces separated from the ice mass.

A system for operating a development platform in an icy marine environment is also provided herein. The marine environment defines a large body of water, a water surface, and ice masses floating therein.

In one embodiment, the system includes a substantially stationary development platform. The development platform is preferably configured for hydrocarbon development operations. The platform is positioned in the icy marine environment. The system also includes an intervention vessel. The intervention vessel is configured to float in the marine environment.

The system further includes a water-agitating mechanism. The water-agitating mechanism is mechanically connected to and operates on the intervention vessel. The water-agitating mechanism is configured to propagate artificially generated waves towards a leading edge of the ice mass. In this way, the ice mass is fractured along the ice mass along its leading edge. This, in turn, causes small ice pieces to separate from the ice mass.

The water-agitating mechanism may be in accordance with any of the illustrative mechanisms listed above.

BRIEF DESCRIPTION OF THE DRAWINGS

So that the present inventions can be better understood, certain drawings, charts, graphs and/or flow charts are appended hereto. It is to be noted, however, that the drawings illustrate only selected embodiments of the inventions and are therefore not to be considered limiting of scope, for the inventions may admit to other equally effective embodiments and applications.

FIG. 6A shows the plunger at the top of its stroke above the water.

FIG. 6B shows the plunger at the bottom of its stroke under the surface of the water.

DETAILED DESCRIPTION OF CERTAIN EMBODIMENTS

Definitions

Figure 1:
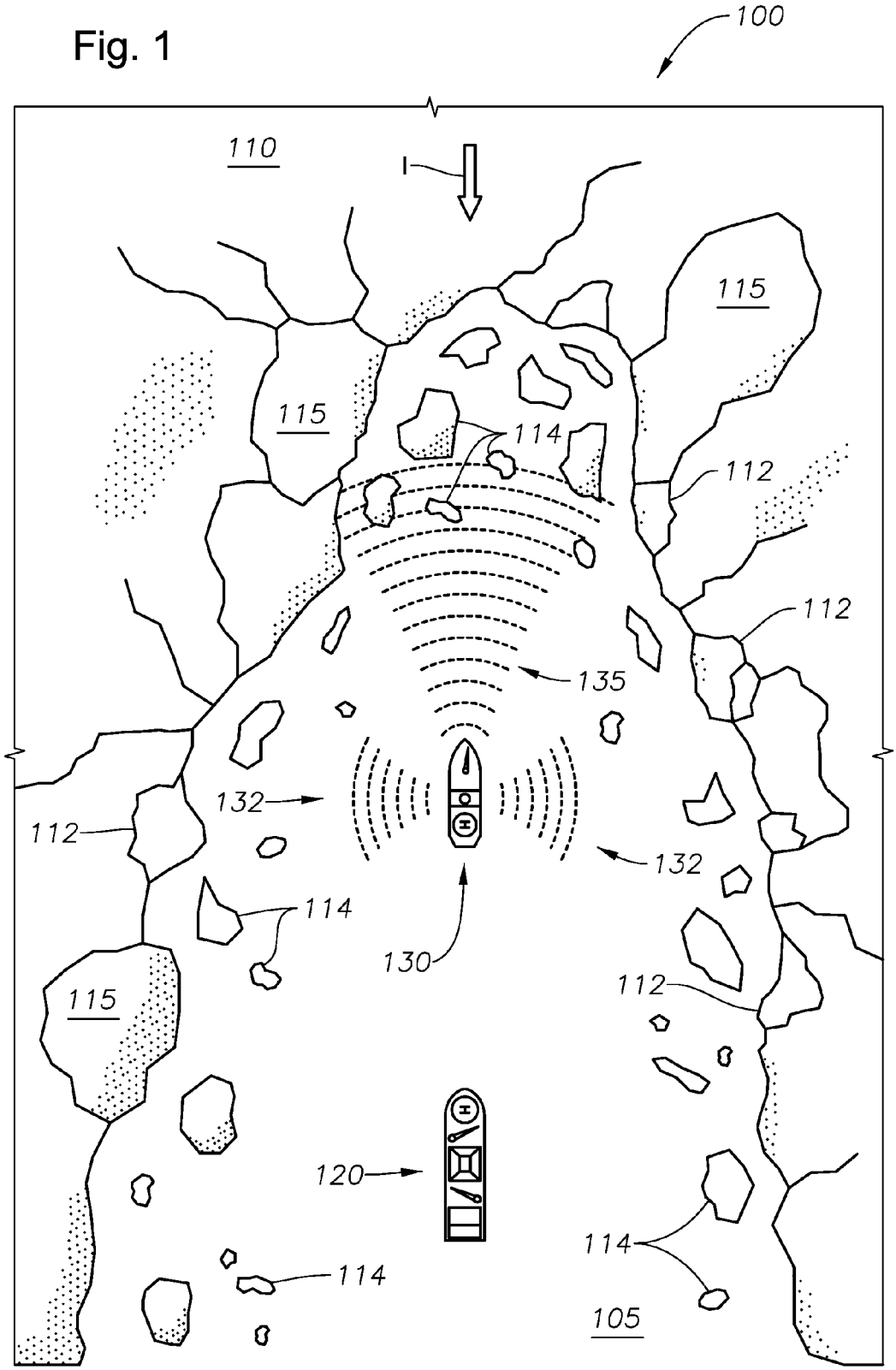
FIG. 1 is a schematic view of a marine ice field wherein hydrocarbon recovery operations are taking place. A vessel having a water-agitating mechanism is provided in the marine ice field to break up ice masses and divert them around a drill ship.

As used herein, the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, pyrolyzed shale oil, synthesis gas, a pyrolysis product of coal, carbon dioxide, hydrogen sulfide and water (including steam).

As used herein, the term "fluid" refers to gases, liquids, and combinations of gases and liquids, as well as to combinations of gases and solids, and combinations of liquids and solids.

As used herein, the term "gas" refers to a fluid that is in its vapor phase at 1 atm and 15° C.

As used herein, the term "oil" refers to a hydrocarbon fluid containing primarily a mixture of condensable hydrocarbons.

The term "Arctic" refers to any oceanographic region wherein ice features may form or traverse through and affect marine operations. The term "Arctic," as used herein, is broad enough to include geographic regions in proximity to both the North Pole and the South Pole.

The term "marine environment" refers to any offshore location. The offshore location may be in shallow waters or in deep waters. The marine environment may be an ocean body, a bay, a large lake, an estuary, a sea, or a channel.

The term "ice mass" means a floating and moving mass of ice, floe ice, or ice berg. The term also encompasses pressure ridges of ice within ice sheets.

The term "platform" means a deck on which offshore operations such as drilling operations take place. The term may also encompass any connected supporting floating structure such as a conical hull.

Description of Selected Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

FIG. 1 is a schematic view of a marine ice field 100. The ice field 100 resides over a large marine body 105. The marine body 105 is preferably a salt water body in the Arctic region of the earth. Examples of such marine areas include the U.S. Beaufort Sea, the Canadian Beaufort Sea, Baffin Bay, Hudson Bay, and the Sea of Okhotsk at Sakhalin Island.

The ice field 100 contains one or more large ice masses. In the arrangement of FIG. 1, a single ice mass is provided at 110. The ice mass 110 is moving in a direction indicated by arrow "I."

The marine ice field 100 is undergoing hydrocarbon development activities. In FIG. 1, a hydrocarbon development platform 120 is provided as part of the hydrocarbon development activities. In the arrangement of FIG. 1, the hydrocarbon development platform 120 is a drill ship. The drill ship 120 operates to drill one or more wellbores through subsurface strata. The drill ship 120 is then used to complete the wellbores in such as way as to safely and efficiently produce valuable hydrocarbons to the earth surface.

While a drill ship 120 is shown in FIG. 1, it is understood that the hydrocarbon development platform 120 may be another type of platform. For example, the hydrocarbon development platform 120 may be a production platform, a workover platform, a floating production, storage and offloading ("FPSO") vessel, an offshore workboat, a catenary anchor leg mooring ("CALM") buoy, or an oceanographic survey vessel.

The hydrocarbon development platform 120 is positioned in the ice field 100. During warmer summer months, the marine body 105 is generally free of large ice masses such as ice mass 110. The Arctic area may have smaller floating ice bodies, but these generally are not a threat to operations on the hydrocarbon development platform 120 as they can be quickly diverted or broken by an ice breaking vessel. However, it is desirable to extend operations on the hydrocarbon development platform 120 both earlier and later in the summer (ice-free) season. This creates a commercial risk to the hydrocarbon development platform 120, not to mention matters of safety to operations personnel.

In FIG. 1, the hydrocarbon development platform 120 is present in the marine body 105 during a time in which a large ice mass 110 is present. It can be seen from arrow "I" that the ice mass 110 is moving towards the location of the hydrocarbon development platform 120. Thus, the hydrocarbon development platform 120 is at risk.

To avoid damage to the hydrocarbon development platform 120, an intervention vessel 130 is provided between the floating ice mass 110 and the hydrocarbon development platform 120. The intervention vessel 130 is preferably a ship-shaped vessel capable of self-propulsion by means of propellers and propeller shafts.

The intervention vessel 130 is preferably equipped with integral ice-breaking capability. This means that the intervention vessel 130 preferably has a strengthened hull, a rounded, ice-clearing profile or shape, and engine power to push over ice masses within ice-covered waters. To pass through ice-covered waters, the intervention vessel 130 uses momentum and power to drive its bow up onto an ice mass. The ice is incrementally broken under the weight of the ship. Because a buildup of broken ice in front of the intervention vessel 130 can slow it down more than the breaking of ice itself, the speed of the ship is increased by having a specially designed hull to direct the broken ice around or under the vessel 130.

While it is preferred that the intervention vessel 130 be an ice-breaking ship, it is within the scope of the inventions herein that the intervention vessel be moored to the ocean bottom. In this instance, the intervention vessel 130 is towed into position between the hydrocarbon development platform 120 and the direction from which any ice masses will approach.

In either arrangement, the intervention vessel 130 is equipped with a water-agitating mechanism. The water-agitating mechanism resides within the intervention vessel 130 or is supported by the intervention vessel 130 within the marine body 105. The water-agitating mechanism generates artificial waves that propagate through the marine body 105 and impact the large ice mass 110.

In FIG. 1, action of the water-agitating mechanism is immediately seen from the intervention vessel in wakes 132. More importantly, waves created through operation of the water-agitating mechanism are seen at 135. The waves 135 cause the ice mass 110 to be oscillated upon the surface of the marine body 105.

It is known that wave action can break up ice masses. Some research has been conducted by others to study the effects of waves in order to both understand ice morphology at the leading ice edges and to understand wake impacts on the ice edges of icebreaker-maintained shipping lanes. Two such studies are reported in C. Fox. and V. A. Squire, "Strain in Shore Fast Ice Due to Incoming Waves and Swell," Journal of Geophysical Research, Vol. 96, No. C3, pp. 4531-4547 (Mar. 15, 1991); and D. Carter, Y. Ouellet, and P. Pay, "Fracture of a Solid Ice Cover by Wind-induced or Ship-generated Waves," Proceedings of the 6$^{th}$ International Conference on Port and Ocean Engineering under Arctic Conditions, Quebec, Canada, pp. 843-845 (1981).

Through research and numerical modeling, Fox and Squire found that "for 1 m [thick] ice, waves in the broad 5- to 10-second [frequency] range can break ice if their amplitude is 90 mm or more." Fox and Squire further reported that "a 15-second wave would need to have an amplitude of 280 mm and a 20-second wave would need an amplitude of 630 mm." Assuming the Fox and Squire analysis is of the correct magnitude, first year ice floating in an Arctic production area can be fractured using waves artificially generated at the proper frequency.

In FIG. 1, it can be seen that waves 135 artificially generated from the intervention vessel 130 have begun to fracture the ice mass 110. First, small ice pieces 112 are formed near the ice edge along the marine body 105. Further, large ice pieces 115 are formed interior from the ice edge. The large ice pieces 115 will be broken into smaller pieces as the waves 135 continue to be generated by the water-agitating mechanism.

In operation, the generation of waves 135 will cause the smaller ice pieces 112 to form and then break off from the ice mass 110. As the smaller ice pieces 112 break away, the larger ice pieces 115 will become the new ice edge. The continued wave action from waves 135 will cause the larger ice pieces 115 (now at the ice edge) to break into new smaller ice pieces 112. The new smaller ice pieces 112 will then break off from the ice mass 110, thus enabling a break-up of the entire ice mass 110 over time.

As the smaller ice pieces 112 break away from the ice mass 110, the smaller ice pieces 112 begin to independently float in the marine body 105. This creates small floating ice pieces 114. Action of the waves 135 will not only break the ice mass 110 into smaller fractured ice pieces 115, 112, and small floating ice pieces 114, but will also push the small floating ice pieces 114 away from the intervention vessel 130. In addition, the action of the wakes 132 will urge the small floating ice pieces 114 away from the intervention vessel 130. Of greater importance, the action of the waves 135 and the wakes 132 will keep the small floating ice pieces 114 cleared from the hydrocarbon development platform 120.

A number of different mechanisms are proposed herein for propagating surface waves across a marine body. These are presented in and discussed in connection with FIGS. 2 through 7, below.

Figure 2A:
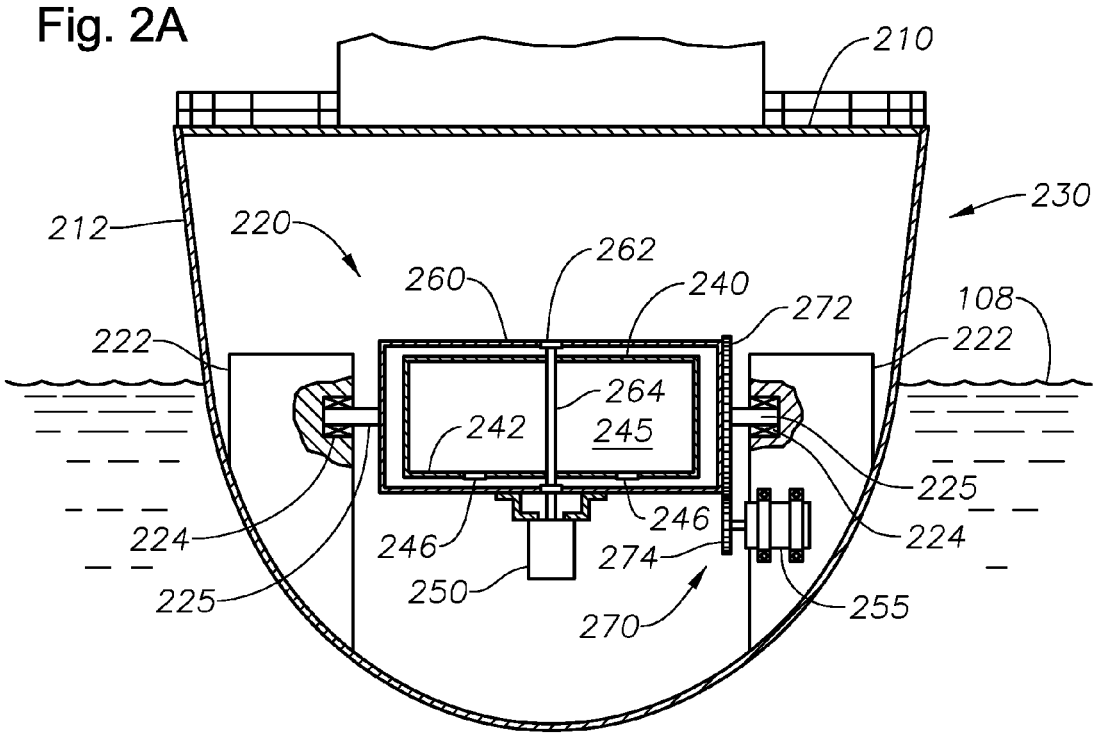
FIG. 2A is a cross-sectional view of an intervention vessel having a water-agitating mechanism, in a first embodiment. Here, the water-agitating mechanism is a hydro-gyroscope for inducing motion of the vessel.

First, FIG. 2A provides a cross-sectional view of an intervention vessel 230 having a water-agitating mechanism, in a first embodiment. The intervention vessel 230 includes a deck 210 and a hull 212. The water-agitating mechanism is shown within the hull 212 of the vessel 230 at 220.

The vessel 230 is representative of the intervention vessel 130 of FIG. 1. In this respect, the vessel 230 is a ship-shaped vessel preferably having ice-breaking capabilities. In addition, the vessel 230 preferably has a large water displacement for generating substantial surface waves 135 during motion.

In the arrangement of FIG. 2, the water-agitating mechanism 220 is a gryoscopic system. Gyroscopes are commonly used in modern marine structures for providing stability to vessels deployed on the high seas. Stabilization increases passenger comfort and safety, reduces wear and tear on equipment, and increases the accuracy of warship artillery.

A gryoscopic system uses angular momentum and precession to counter ship oscillations. A gyroscope mounted with its gimbal axis orthogonal to the major axis of a ship serves to limit rolling motion. Further, a gyroscope mounted with the gimbal axis parallel to the major axis of the ship reduces pitching motion. Larger vessels require a larger gyroscopic system that can provide greater stabilization forces, while smaller vessels may employ a smaller gyroscopic system.

An early gyroscope patent is U.S. Pat. No. 1,150,311, which issued in 1915 to inventor Elmer A. Sperry. The '311 patent was entitled "Ship's Gyroscope." Mr. Sperry's gyroscope employed a large, solid spinning mass that precessed about gimbal bearings. The gimbal bearings were connected to a frame. The frame, in turn, was operatively connected to the hull of a ship.

Mr. Sperry's gyroscope was utilized by the U.S. Navy as an early gyro-stabilizer system. According to one publication, the gyro was installed aboard a small 700 ton destroyer, and in a submarine. Using the centrifugal motion of the spinning mass, gyrsoscopic forces were transmitted to the hulls of the naval vessels through the gimbal axis. Depending upon the orientation of the gimbal axis, the gyroscopic forces could stabilize a floating vessel either as to pitch or as to roll.

Mr. Sperry's gyroscope was "active" in operation, as opposed to being "passive." In this respect, the Sperry gyroscope used a small gyroscope that sensed the onset of rolling motion. This small gyroscope was electrically connected to the switch of a motor that actuated a precessional gear mounted on a much larger gyroscope. A small gyroscope is more sensitive to rolling motion at inception than a large gyroscope. By activating the motor connected to the precessional gear of the large gyroscope, the large gyroscope was forced to precess at the moment it was needed. Further the motor can increase or decrease the angular velocity of precession to increase or decrease the stabilizing torque as needed based on the magnitude of the external torque.

Stabilizing torque of a gyroscope is a function of several factors. These include mass of the flywheel, or "rotor," angular velocity of the rotor, radius of the rotor, and angular velocity of precession of the rotor when subject to an external torque. In order to provide stabilization for a large vessel such as a war ship, Mr. Sperry's ship gyroscope was required to utilize a large metal rotor having a great deal of mass. According to one publication, Mr. Sperry's gyroscope as utilized by the U.S. Navy weighed 5 tons.

In the present application, the gyroscopic system 220 is used not for vessel stabilization, but to actually induce side-to-side motion. The side-to-side motion may be either a rolling motion, a pitching motion, or intermittently a rolling motion and a pitching motion. The purpose is to create waves 135 that hit the ice edge and to create break-up of the ice mass 110. To effectuate the rolling motion and the pitching motion, precession is forced upon a gear motor 255 according to a predetermined frequency and angle.

As seen in FIG. 2A, the gryoscopic system 220 includes frame support members 222. The frame support members 222 are secured to the hull 212 of the vessel 230 at an orientation that is orthogonal to the length (or major axis) of the vessel 230. This allows the hydro-gyroscope 220 to de-stabilize the vessel 230 so that it may roll from side-to-side. If the operator desires to de-stabilize the vessel 230 as to pitch, the frame support members 222 are secured to the hull 212 of the vessel 230 at an orientation that is parallel to the length of the vessel 230.

In one arrangement, a pair of vessel de-stabilizing apparatuses 220 is provided in the hull 212 of the vessel 230, with one being positioned to de-stabilize the vessel 230 as to pitch forces, and the other being positioned to de-stabilize the vessel 230 as to roll forces. In another arrangement, a single gyroscope 220 may be employed, with the gyroscope being rotatable within the hull 212 of the vessel 230. For example, the opposing frame support members 222 could be placed on a circular track and given rotational movability along a horizontal plane. In this way, a single gyroscope 220 (whether active or passive) may be employed to de-stabilize the vessel 230 selectively as to both pitch forces and roll forces.

The manufacture of gyroscopic systems is understandably expensive. In addition, the added weight of the spinning mass of a gyroscope increases the fuel consumption of the vessel 230 when in transit. Therefore, it is preferred that the gyroscopic system 220 be a "hydro-gyroscope," meaning a gyroscopic device that employs a container that may be selectively filled with sea water, and later emptied. Such a hydro-gyroscope is disclosed in U.S. Pat. No. 7,458,329, entitled "Hydrogryo Ship Stabilizer and Method for Stabilizing a Vessel."

The illustrative gyroscopic system 220 includes a spinning mass such as a liquid container 240. The spinning liquid container has a cylindrical wall 242 that defines an internal chamber 245. The chamber 245 provides an internal flow path in which fluid rotationally travels. Spinning movement of the liquid container 240 creates the gyroscopic forces applied to the hull 212 of the vessel 230.

A means is provided for inducing rotational motion of the liquid within the inner chamber 245 of the container 240. In the embodiment of FIG. 2A, the means is a motor 250. The motor 250 is a mechanical motor, and may be either electrically powered, steam powered, hydraulically powered, or powered by a hydrocarbon fuel. The motor 250 is connected to a shaft 264 and mounted to a gimbal frame 260. This allows the liquid container 240 to precess along the major axis of the vessel 230.

The gyroscopic system 220 also includes gimbal connections 224. The gimbal connections 224 are secured between the opposing frame support members 222. The gimbal connections 224 are connected by a shaft 225 that supports the gimbal frame 260 and that forms a gimbal axis for the liquid container 240. Each of the gimbal connections 224 includes a bearing that provides relative rotational movement between the gimbal frame 260 and the frame support members 222. The frame support members 222, in turn, are secured to the hull 212 of the vessel 230.

The spinning liquid container 240 (or other mass) is provided as part of a controlled gear system 270. In this respect, the gear system 270 is neither passive nor active, but provides precessional forces in response to signals sent by a controller. A controller is seen at 280 in FIG. 2C.

Figure 2B:
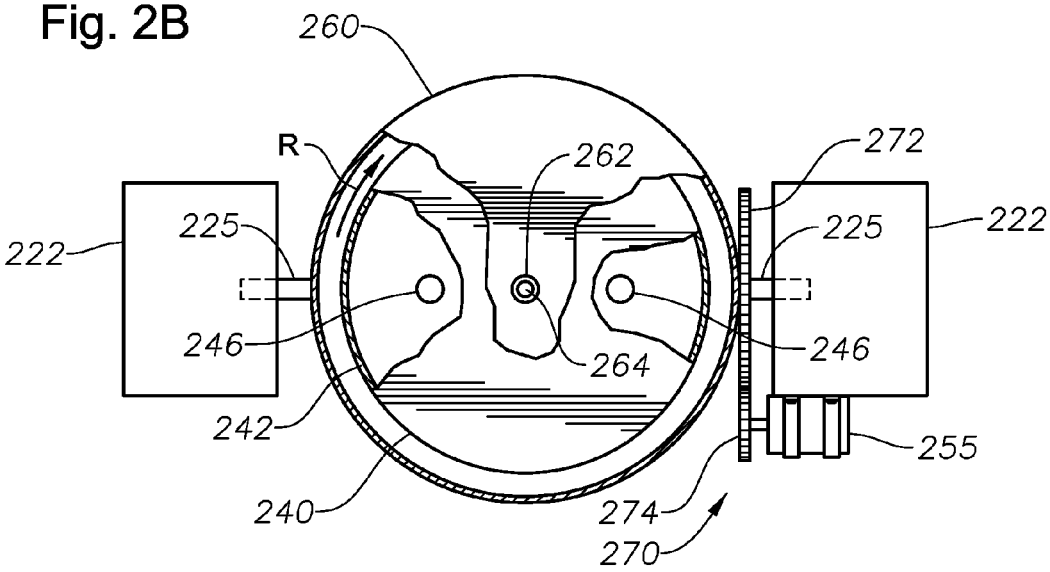
FIG. 2B is a plan view showing the hydro-gyroscopic system of FIG. 2A.
Figure 2C:
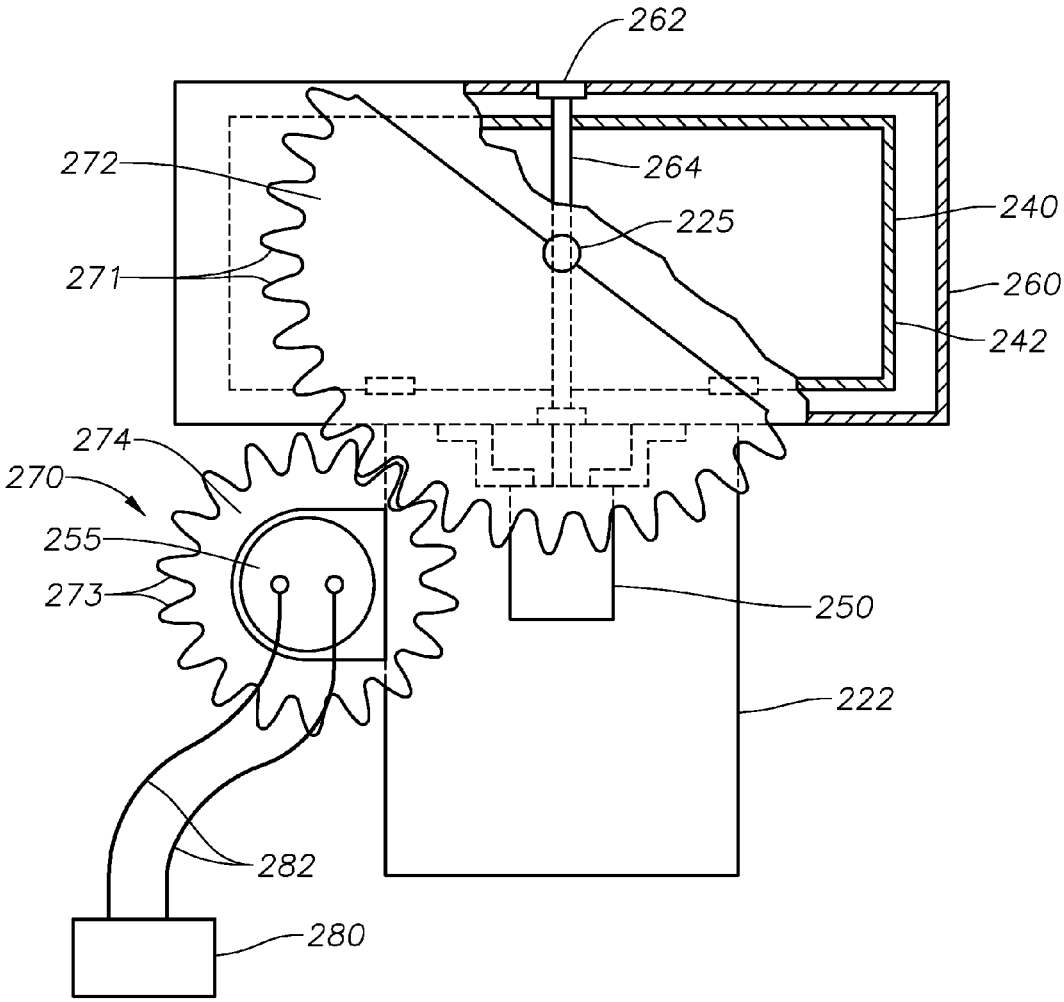
FIG. 2C is a side view of the hydro-gyroscope of FIG. 2A. Here, the gear system for forced precession is seen.

In the arrangement of FIGS. 2A and 2C, the gear system 270 includes a first gear 272 connected to the gimbal axis 225. The first gear 272 turns in response to rotational mechanical force (such as by teeth) provided from a second gear 274. The second gear 274, in turn, is driven by a gear motor 255. Thus, movement by the gear motor 255 forces the gimbal frame 260 to turn, thereby creating precessional forces on the vessel 230.

FIG. 2B is a top view of the gyroscopic system 220 of FIG. 2A. Arrow R indicates the direction of rotation of the liquid container 240. Of course, the container 240 may be urged by the motor 250 to spin in either direction.

Visible in the top view of FIG. 2B is a bearing connector 262. The bearing connector 262 is provided at an interface with the gimbal frame 260 and a rotational shaft 264. The bearing connector 262 allows the liquid container 240 to rotate relative to the gimbal frame 260 around an axis that is essentially vertical to the hull 212 of the vessel 230 when the gyroscopic system 220 is not precessing.

FIG. 2C is a side view of the gyroscopic system 220 of FIG. 2A. Here, the gear system 270 is more clearly seen. The gear system 270 again includes a first gear 272 and a second gear 274. The first gear 272 comprises a first set of teeth 271, while the second gear 274 comprises a second set of teeth 273. The first set of teeth 271 and the second set of teeth 273 are configured and dimensioned to interlock as is known for a gear system.

A controller 280 is provided as part of the gyroscopic system 220. The controller 280 is in electrical communication with the gear motor 255 by wires 282, and sends instructions to the gear motor 255 to turn the second gear 274 clockwise and counter-clockwise in order to provide reciprocating precessional forces to the spinning liquid container 240.

In operation, the illustrative liquid container 240 serves as a hydro-gyro rotor. Preferably, the spinning liquid container 240 is filled with seawater after the intervention vessel 230 has been transported to the desired location in the marine body 105. The container 240 filled with seawater spins about the rotational axis 264 using power from the motor 250. The bearings 262 and shaft 225 provide lateral support for the liquid container 240 relative to the gimbal frame 260, while allowing rotational movement of the liquid container 240. The liquid container 240, the gimbal frame 260, and motor 250 are free to precess on the gimbal axis provided by the shaft 225 and frame connectors 224. For example, when creating rolling motion in the vessel 230, the motor 250 would swing like a pendulum into and out of the page in the view of FIG. 2A.

It can be seen from FIGS. 2A through 2C that a unique water-agitating mechanism 220 is provided. The water-agitating mechanism 220 generates waves 135 through a ship-mounted gyroscope. The gyroscope is preferably a hydro-gyroscope, but may operate through a solid spinning mass. Other arrangements for a hydro-gyroscope are presented in U.S. Pat. No. 7,458,329, mentioned above. The '329 patent is incorporated herein by reference in its entirety.

The gyroscope that includes a spinning mass such as fluid container 240 undergoes forced precession. The precession takes place at a desired frequency as determined by the controller 280. The forced precession induces rocking or pitching of the vessel 230. This rocking or pitching motion of the vessel 230, in turn, generates a continuous train of waves 135 in the marine body 105. The waves 135 propagate away from the vessel 230 and into the ice mass 110 to induce wave fracture. In this respect, ice break-up is caused by the brittle ice being cantilevered over or spanning across wave troughs.

Another means for artificially generating waves 135 within the marine body 105 involves the use of air guns. Air guns operate by containing compressed gas at high pressure (e.g., 2,000-3,000 psia) within a valve chamber. The compressed gas is ordinarily air. Air guns are commonly used as acoustic sources for marine seismic reflection and refraction surveys. Typically, one or more passages is provided in the gun to release the gas from the valve chamber and into a surrounding medium, that is, sea water. The passage remains closed while the pressure (as from a compressor on a surface vessel) is built up in the chamber. The passage is opened when the gun is "fired," allowing the compressed gas to expand out of the chamber and into the surrounding medium.

Figure 3:
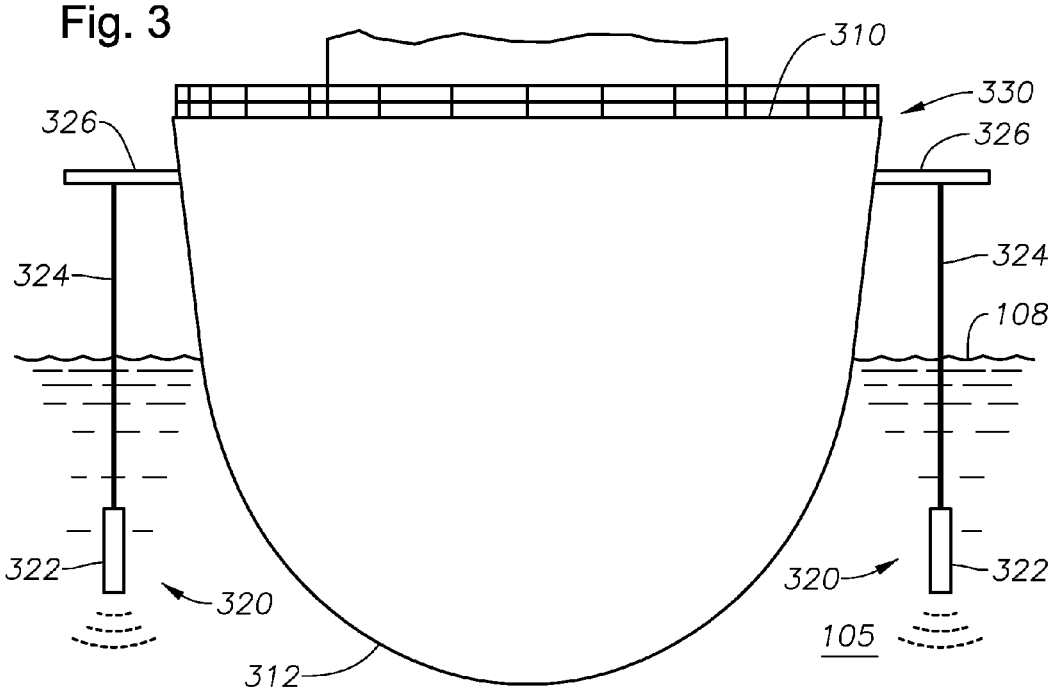
FIG. 3 is an end view of a vessel having a water-agitating mechanism, in a second embodiment. Here, the water-agitating mechanism is a plurality of pneumatic guns.

FIG. 3 is a side view of an intervention vessel 330 using a water-agitating mechanism 320 in a second embodiment. The intervention vessel 330 includes a deck 310 and a hull 312. The vessel 330 is representative of the intervention vessel 130 of FIG. 1. In this respect, the vessel 330 is a ship-shaped vessel preferably having ice-breaking capabilities. However, it is understood that the vessel 330 may be of any shape. For example, a non-ship-shaped vessel such as an offshore working platform may utilize the water-agitating mechanism 320.

In the vessel 330 of FIG. 3, the water-agitating mechanism 320 comprises a plurality of pneumatic guns 322. The pneumatic guns 322 are suspended from cables 324. The cables 324, in turn, are supported by cable rods 326 extending laterally from the vessel 330. The pneumatic guns 322 extend into the marine body 105. Alternatively, in some embodiments the pneumatic guns 322 may be extended or towed behind the vessel.

The pneumatic guns 322 are preferably large-diameter, cylinder-shuttle air guns. Such guns have known uses in the context of seismic exploration. A specific exemplary air gun design is disclosed in U.S. Pat. No. 5,432,757, entitled "Large-Diameter, Cylinder-Shuttle Seismic Airgun Method, Apparatus and Towing System." This patent is incorporated herein by reference in its entirety.

Using the pneumatic guns 322, powerful impulses of air may be released into the marine body 105. Of benefit, the impulses are readily repeatable at a desired frequency. In the present application, the air guns 322 may be fired to release powerful impulses on a cycle such as every two seconds (0.5 Hz), every five seconds (0.2 Hz), every ten seconds (0.1 Hz), or other frequencies.

In operation, air tubes (not shown) deliver air from an air canister or air pump on the vessel 330 to the air guns 322. The air is delivered to air chambers under pressure within the air guns 322. A trigger mechanism is used to actuate, or "fire," the air guns 322. The trigger mechanism may be an electrically operated trigger valve, or solenoid valve. Upon firing, the pressurized gas is abruptly released from the air chambers and into the surrounding water medium, i.e., salt water.

The release of air from the plurality of air guns 322 is synchronized. In this way, wakes 132 and waves 135 are created. The waves 135 travel towards the ice mass 110 to cause ice fracture and break-up.

Another means for artificially generating waves 135 within the marine body 105 involves the use of large paddles. The paddles strike the surface of the marine body 105 and then stroke through the water.

Figure 4:
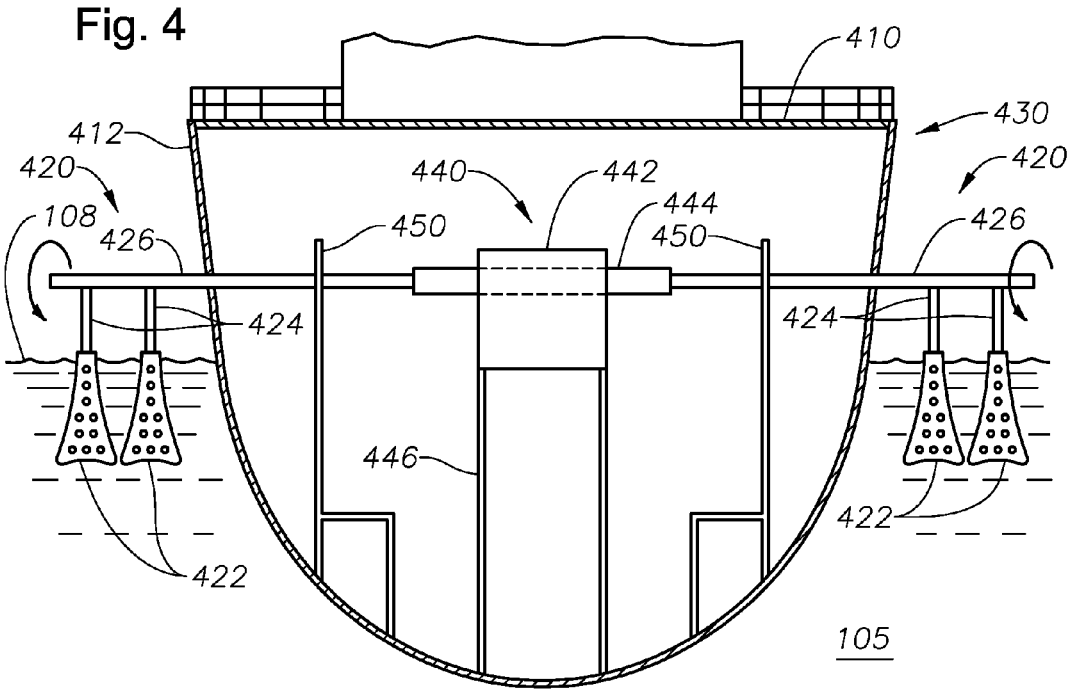
FIG. 4 is a cross-sectional view of a vessel having a water-agitating mechanism in a third embodiment. Here, the water-agitating mechanism is a plurality of rotating paddles.

FIG. 4 is a cross-sectional view of an intervention vessel 430 using a water-agitating mechanism 420 in a third embodiment. The intervention vessel 430 includes a deck 410 and a hull 412. The vessel 430 is again representative of the intervention vessel 130 of FIG. 1. In this respect, the vessel 430 is a ship-shaped vessel preferably having ice-breaking capabilities. However, it is understood that the vessel 430 may be of any shape.

In the vessel 430 of FIG. 4, the water-agitating mechanism 420 comprises a plurality of paddles 422. The paddles 422 are supported by oars 424. The oars 424, in turn, are supported by a rotating shaft 426 that extends laterally from each side of the vessel 430.

In order to generate waves 135, the shaft 426 is rotated. Rotation may be clockwise, counter-clockwise, or intermittently clockwise and counter-clockwise. Rotation of the shaft 426 is driven by a motor assembly 440. The motor assembly 440 includes a motor 442. The motor 442 is supported by a stand or platform 446. The motor 442 imparts rotational movement to a drive shaft 444. The drive shaft 444 preferably extends from each end of the motor 442, though it may reside entirely within a housing of the motor 442.

The drive shaft 444 is connected to the rotating shaft 426. The rotating shaft 426 is supported within the hull 412 of the vessel 430 by support frames 450. In the arrangement of FIG. 4, the support frames 450 are connected to the inside of the hull 412. Opposing support frames 450 are provided on either side of the motor 442.

Rotation of the drive shaft 444 causes the rotating shaft 426 to rotate. This, in turn, causes the paddles 422 to hit the surface of the marine body 105. The paddles 422 plunge through the water within the marine body 105 and then come back out for another cycle.

The frequency at which the paddles 422 strike the surface of the marine body 105 and then turn through the water is a function of the speed of the motor 442. Ideally, the paddles 422 strike the water in unison. The oars 424 and connected paddles 422 rotate at a frequency of about three to five seconds.

The oars 424 and connected paddles 422 are dimensioned to create waves 135 within the marine body 105. In one aspect, the oars 424 and connected paddles 422 are about 30 to 50 feet in length. The rotating shaft 426 ideally turns at a height that is about 15 feet above the surface of the marine body 105. This allows the paddles 422 to extend about 15 to 34 feet below the water surface 108.

In the view of FIG. 4, only one rotating shaft 426 is shown, and only one row of paddles 422 is seen. However, the operator may choose to have more than one motor 442 so that additional rotating shafts 426 with connected oars 424 and paddles 422 may be turned. The use of multiple rows of paddles 422 would increase the amplitude of the waves 135. This, in turn, would provide for more efficient breakage of the ice mass 110. In one embodiment, three rotating shafts 426 with connected oars 424 and paddles 422 are turned.

It is understood that the movement of the paddles 422 through the water will urge the intervention vessel 430 to move across the water. It is desirable for the vessel 430 to remain substantially stationary in a position between the hydrocarbon development platform 120 and the oncoming ice mass 110. Therefore, the vessel 430 may be moored to the bottom of the marine body 105 using anchors and catenary mooring lines (not shown). Alternatively, dynamic positioning using azimuthing propulsion motors (not shown) may be employed to counter any translation of the vessel 430 across the marine body 105.

The use of azimuthing propulsion motors as suggested above may themselves create substantial artificial wave movement. This would be even without the paddles 422. Thus, another means proposed herein for artificially generating waves 135 within the marine body 105 involves the use of azimuthing propulsion motors.

Figure 5:
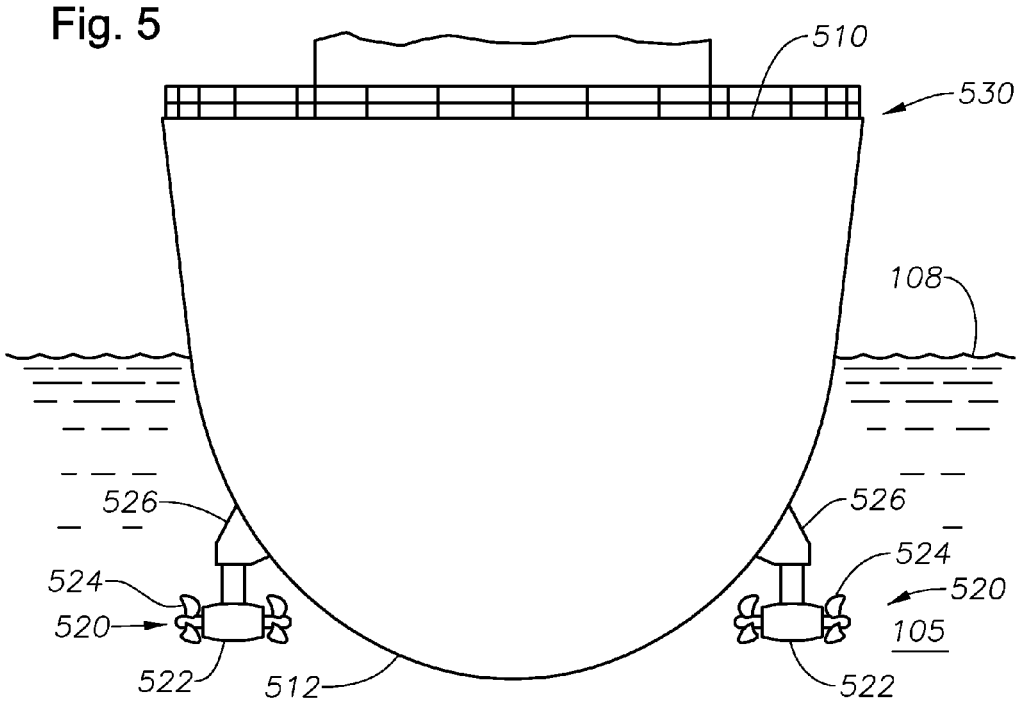
FIG. 5 is an end view of a vessel having a water-agitating mechanism, in a fourth embodiment. Here, the water-agitating mechanism is a pair of offsetting propulsion motors.

FIG. 5 is a cross-sectional view of an intervention vessel 530 having a water-agitating mechanism 520, in a fourth embodiment. The intervention vessel 530 includes a deck 510 and a hull 512. The vessel 530 is again representative of the intervention vessel 130 of FIG. 1. In this respect, the vessel 530 is a ship-shaped vessel preferably having ice-breaking capabilities. However, it is understood that the vessel 530 may be of any shape.

In the vessel 530 of FIG. 5, the water-agitating mechanism 520 comprises one or more pairs of propulsion motors 522. The propulsion motors 522 operate as azimuth thrusters. Azimuth thrusters are known as a means for propelling a large ship. Azimuth thrusters have also been used as part of dynamic positioning systems for station-keeping of floating offshore platforms.

Generally, an azimuth thruster is a configuration of ship propellers placed in pods. The pods are typically placed underneath a ship's hull or underneath a platform for a floating offshore structure. The ship propellers can be rotated in any direction about their mounting axis. This renders the use of a rudder for steering unnecessary. In the context of a large ship, azimuth thrusters give the ship much better maneuverability than a fixed propeller and rudder system. Further, ships with azimuth thrusters do not need tugs to dock, though they may still require tugs to maneuver in tight places.

In FIG. 5, a pair of azimuth thrusters 522 is shown. Each azimuth thruster 522 is supported by the hull 512 of the vessel 530. A support mounting is shown at 526 for each azimuth thruster 522. The support mountings 526 enable the azimuth thrusters 522 to rotate a full 360° relative to the vessel hull 512.

In the arrangement of FIG. 5, each azimuth thruster 522 has at least one propeller 524. The propeller 524 is generally used to move and maneuver the intervention vessel 530 through the marine body 105. However, upon arrival at the desired location between the hydrocarbon production platform 120 and the floating ice mass 110, the azimuth thrusters 522 are rotated so that the propellers 524 face and act against one another.

The opposing disposition of the azimuth thrusters 522 creates offsetting forces that tend to keep the vessel 530 on location, although some intermittent adjustments will be required. To the extent unmanageable drift of the vessel 530 might occur, anchors may be placed on the marine bottom, or the vessel 530 maintained on location through catenary mooring lines (not shown). Alternatively, a separate set of azimuth thrusters (not shown) may be provided for dedicated station-keeping.

The azimuth thrusters 522 and propellers 524 preferably operate through mechanical transmission. This means that a motor (not shown) resides inside the hull 512 of the vessel 530, with the motor being operatively connected to the propeller 524 by gearing. The motor may be diesel or diesel-electric.

In an alternative aspect, the azimuth thrusters 522 operate through electrical transmission. This means that an electric motor operates within the azimuth thruster 522 itself. The electric motor is connected directly to the propellers 524 without gears. The electricity needed to drive the propellers 524 and to rotate the azimuth thrusters 522 is produced by an onboard engine, usually diesel or gas turbine.

In order to generate waves 135, and as shown in FIG. 5, a pair of azimuth thrusters 522 is positioned in opposing relation. Preferably, more than one pair of azimuth thrusters 522 is employed. Preferably, the propellers 524 are intermittently started and stopped in cycles to create waves 135 having well-defined peaks and troughs. This is in addition to the entrainment of air under the ice. The cycles may be, for example, every two to ten seconds or, more preferably, every four to eight seconds.

Another option offered herein for artificially generating waves 135 within the marine body 105 involves the use of subsurface plungers. The plungers strike the surface 108 of the marine body 105 and then stroke vertically down through the water and back up. Alternatively, the plungers vibrate or oscillate quickly in an up-and-down manner under the water.

Figure 6A:
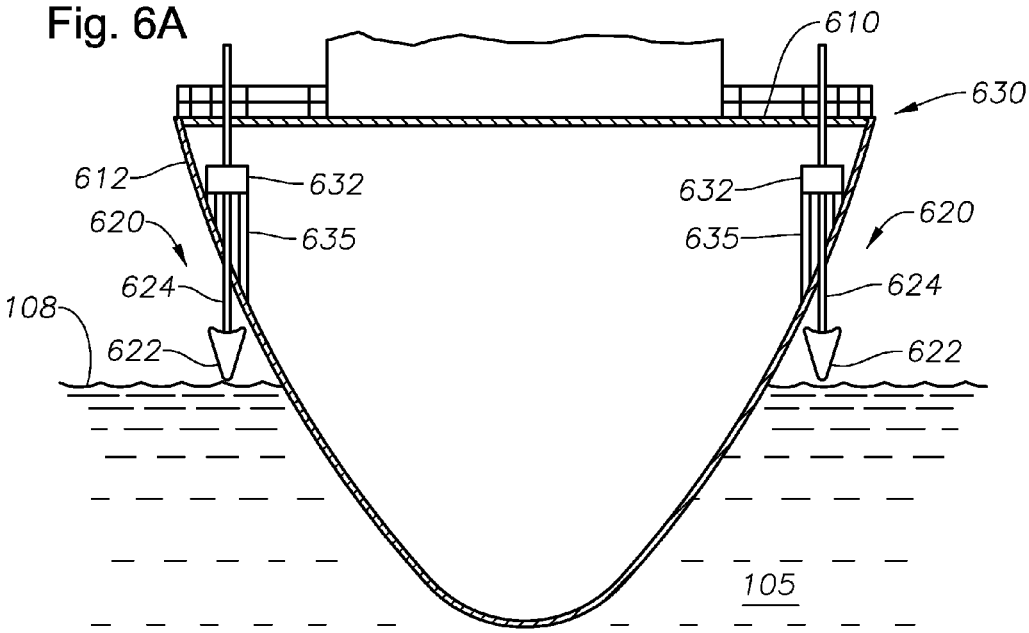
FIGS. 6A and 6B are cross-sectional views of a vessel having a water-agitating mechanism, in a fifth embodiment. Here, the water-agitating mechanism is a plunger having long vertical strokes that move the plunger in and out of the water.
Figure 6B:
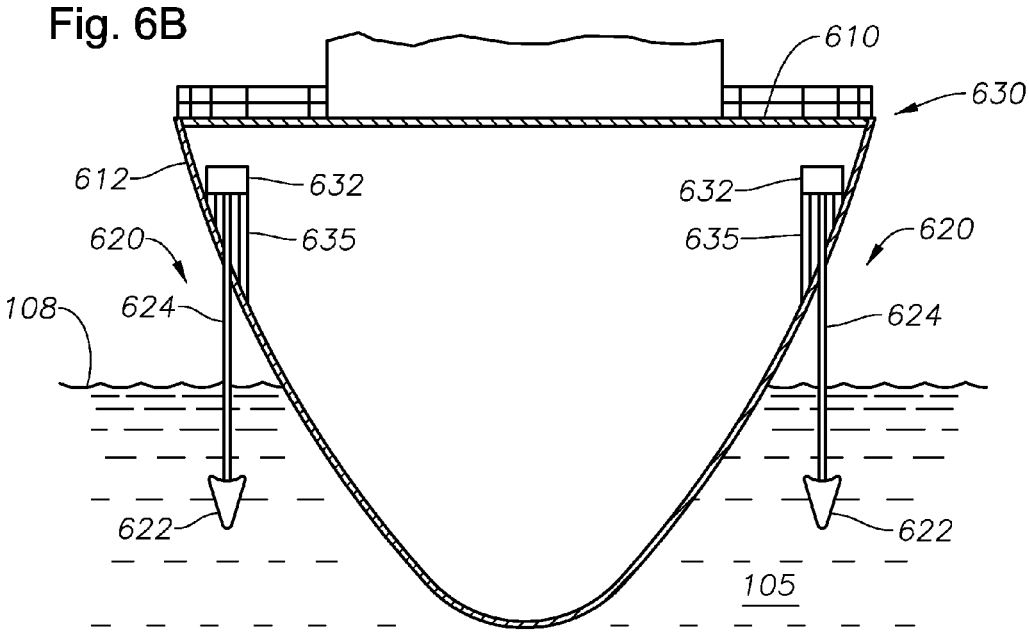

FIGS. 6A and 6B provide cross-sectional views of an intervention vessel 630 using a water-agitating mechanism 620, in a fifth embodiment. The intervention vessel 630 includes a deck 610 and a hull 612. The vessel 630 is again representative of the intervention vessel 130 of FIG. 1. In this respect, the vessel 630 is a ship-shaped vessel preferably having ice-breaking capabilities. However, it is understood that the vessel 630 may be of any shape or may define a floating platform.

In the vessel 630 of FIGS. 6A and 6B, the water-agitating mechanism 620 comprises a plurality of plungers 620. The plungers 622 are supported by vertical rods 624. Each rod 624, in turn, is supported by a reciprocating motor 632. The reciprocating motors 632 cause the rods 624 and connected plungers 622 to reciprocate vertically, that is, up-and-down within the water body 105.

In one aspect, the rods 624 are about 15 to 30 feet in length. In addition, the plungers 622 at the ends of the rods 624 are about 5 to 10 feet in length. Reciprocating motion of the rods 624 and connected plungers 622 creates wakes 132 and causes waves 135 to be propagated towards the ice masses 110.

In FIG. 6A, the plungers 622 are in their raised position. This means the plungers 622 are at the respective tops of their strokes. In this position, the plungers 622 are about 5 to 17 feet above the surface 108 of the marine body 105. In response to movement of the vertical rods 624 by the reciprocating motor 632, the plungers 622 are rapidly lowered into the water. The plungers 622 strike the surface 108 of the marine body 105 and then stroke vertically down through the water.

In FIG. 6B, the plungers 622 are in their lowered position. This means that the plungers 622 are at the respective bottoms of their strokes. In this position, the plungers 622 are about 5 to 17 feet below the surface 108 of the marine body 105. In response to movement of the vertical rods 624 by the reciprocating motor 632, the plungers 622 are rapidly raised, and stroke vertically back up through the water.

In one embodiment, the plurality of plungers 622 reciprocate according to a stroke that is about 5 to 20 feet. The frequency of the strokes may be about every three to ten seconds (0.333 Hz to 0.1 Hz). In this instance, the top of the strokes is at or above the surface of the body of water, and the bottom of the strokes is below the surface of the body of water.

Figure 7:
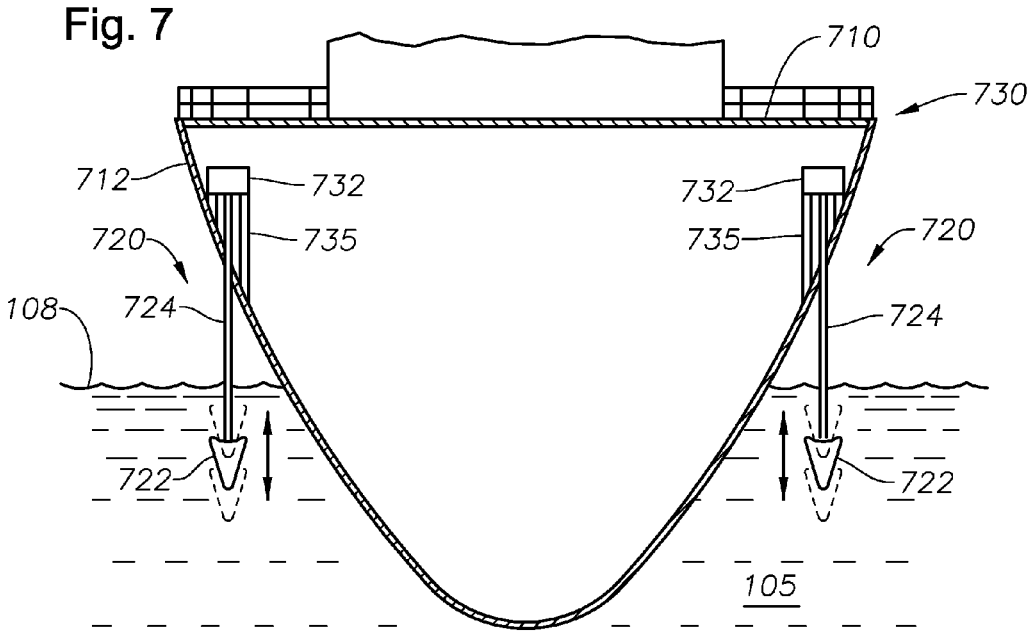
FIG. 7 is a cross-sectional view of a vessel having a water-agitating mechanism, in a sixth embodiment. Here, the water-agitating mechanism is a plunger oscillating with fast, short strokes under the water.

A final and related method for creating artificially-generated waves also involves the use of a plunger. FIG. 7 is a cross-sectional view of a vessel 730 having a water-agitating mechanism 720, in a sixth embodiment. Here, the water-agitating mechanism 720 is again a plunger 722.

The plungers 722 are supported by vertical rods 724. Each rod 724, in turn, is supported by a reciprocating motor 732. The reciprocating motors 732 cause the rods 724 and connected plungers 722 to reciprocate. Reciprocation may be vertical, that is, up-and-down, within the water body 105, or may be lateral or circular.

In one aspect, the rods 724 are about 10 to 20 feet in length. In addition, the plungers 722 at the ends of the rods 724 are about 5 to 10 feet in length. Reciprocating motion of the rods 724 and connected plungers 722 creates wakes 132 and causes waves 135 to be propagated towards the ice masses 110. It is preferred that the plurality of plungers 722 reciprocate substantially simultaneously.

It is noted that the plungers 722 may alternatively be shaped as paddles, such as paddles 422 of the water-agitating mechanism 420 in FIG. 4. In this arrangement, reciprocation or vibration by the motors 732 would preferably be more of a lateral movement than a vertical movement. In either instance, the reciprocating motors 732 provide short, fast strokes to vibrate a device under the water.

In the embodiment of FIG. 7, the plurality of plungers 722 may reciprocate according to a stroke that is about 1 to 5 feet. The frequency of the strokes may be about 0.1 to 2.0 seconds (10.0 Hz to 0.5 Hz). In this instance, both the top and the bottom of each stroke is below the surface 108 of the body of water 105.

In one embodiment, the intervention vessel 130 is an azimuthal stern drive icebreaker. The icebreaker would be mounted with an ice-breaking mechanism such as the controlled gyroscopic system 220. This has the added advantage of using its propeller wash to push ice pieces 114 out of the path of the development platform 120.

Figure 8:
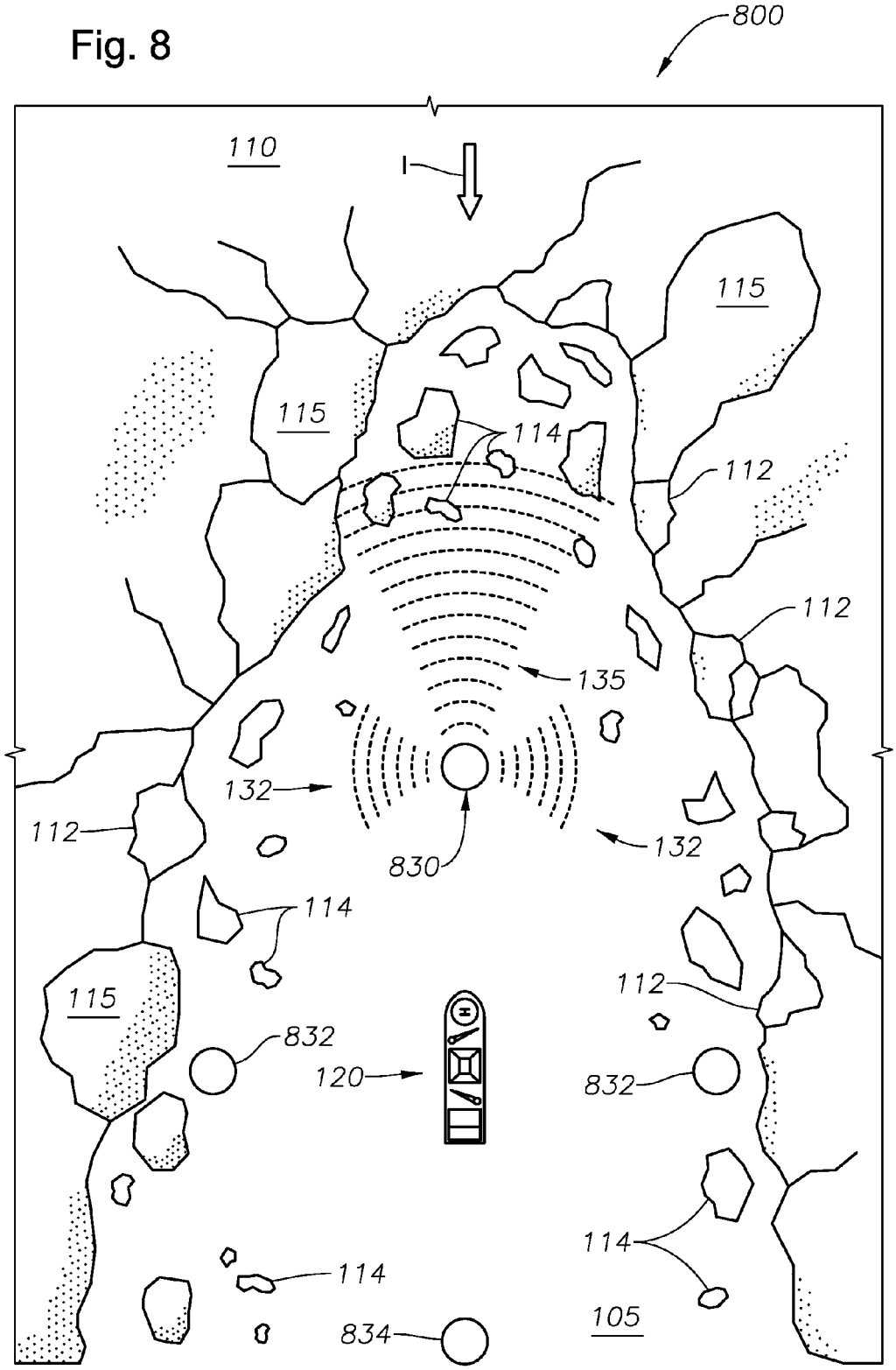
FIG. 8 is a schematic view of a marine ice field wherein hydrocarbon recovery operations are taking place, in an alternate embodiment. Here, the intervention vessel is at least one moored buoy, with each moored buoy having an attached water-agitating mechanism field to break up ice masses.

FIG. 8 is a schematic view of a marine ice field 800 wherein hydrocarbon recovery operations are taking place, in an alternate embodiment. The marine ice field 800 of FIG. 8 is the same as the marine ice field 100 of FIG. 1. In this respect, the ice field 100 resides over a large marine body 105. The marine body 105 is preferably a salt water body in the Arctic region of the earth.

The ice field 800 contains one or more large ice masses, such as the ice mass 110. The ice mass 110 is moving in a direction indicated by arrow "I."

The marine ice field 800 is undergoing hydrocarbon development activities. In FIG. 8, a hydrocarbon development platform 120 is again provided as part of the hydrocarbon development activities. The depicted platform 120 is a drill ship. While a drill ship 120 is shown in FIG. 8, it is understood that the platform 120 may be another type of vessel. For example, the platform 120 may be a production platform, a workover platform, a floating production, storage and offloading ("FPSO") vessel, an offshore workboat, a catenary anchor leg mooring ("CALM") buoy, or an oceanographic survey vessel. Other types of vessels for platform 120 include a construction vessel as may be used to install subsea equipment or to lay pipe, a subsea cable installation vessel, a diver support vessel, an oil spill response vessel, or a submarine rescue vessel.

The hydrocarbon development platform 120 is positioned in the ice field 100. During warmer summer months, the marine body 105 is generally free of large ice masses such as ice mass 110. The Arctic area may have smaller floating ice bodies, but these generally are not a threat to operations on the hydrocarbon development platform 120 as they can be quickly diverted or broken by an ice breaking vessel. However, it is desirable to extend operations on the hydrocarbon development platform 120 both earlier and later in the summer (ice-free) season. This creates a commercial risk to the hydrocarbon development platform 120, not to mention matters of safety to operations personnel.

In FIG. 8, the hydrocarbon development platform 120 is present in the marine body 105 during a time in which a large ice mass 110 is present. It can be seen from arrow "I" that the ice mass 110 is moving towards the location of the hydrocarbon development platform 120. Thus, the hydrocarbon development platform 120 is at risk.

To avoid damage to the hydrocarbon development platform 120, an intervention vessel 830 is again provided between the floating ice mass 110 and the hydrocarbon development platform 120. In this novel arrangement, the intervention vessel 830 is a moored buoy.

The moored buoy 830 is dimensioned to generate waves of the desired wavelength, amplitude, and period to fracture ice that is approaching the structure 120 to be protected. Preferably, the moored buoy 830 is circular, and has a diameter substantially equivalent to the beam of a drilling vessel. The moored buoy 830 is equipped with an ice-breaking mechanism. Preferably, the ice breaking mechanism is a controlled gyroscopic system that induces precession on a predetermined cycle. Alternatively, the ice-breaking mechanism may be a motor within the buoy 830 that oscillates the buoy 830 up and down by mechanically pulling and releasing on its mooring line or lines (not shown).

In the embodiment shown in FIG. 8, the ice field 800 further includes moored buoys 832 on substantially either side of the first moored buoy 830. These moored buoys 832 likewise have controlled gyroscopic systems or other water-agitating mechanisms attached thereon. The water-agitating mechanisms cause the buoys 830, 832 to oscillate in a manner that produces waves 135. The waves 135 help to break up the ice mass 110 into smaller and still smaller pieces. The moored side buoys 832 may further help to direct smaller ice pieces such as pieces 114 away from the hydrocarbon development platform 120.

It is noted in FIG. 8 that yet a fourth moored buoy 834 is provided. Any number of moored buoys may be selected which oscillate or precess according to a desired frequency in order to generate waves 135. In one aspect, the oscillations are substantially synchronized.

Each buoy 830, 832, 834 may be positioned to protect the development platform 120 from ice moving in a specific direction. In the illustrative arrangement of FIG. 8, four buoys are shown, with one being placed north of the platform 120, one being placed south of the platform 120, one being positioned east of the platform 120, and one being placed west of the development platform 120.

Figure 9:
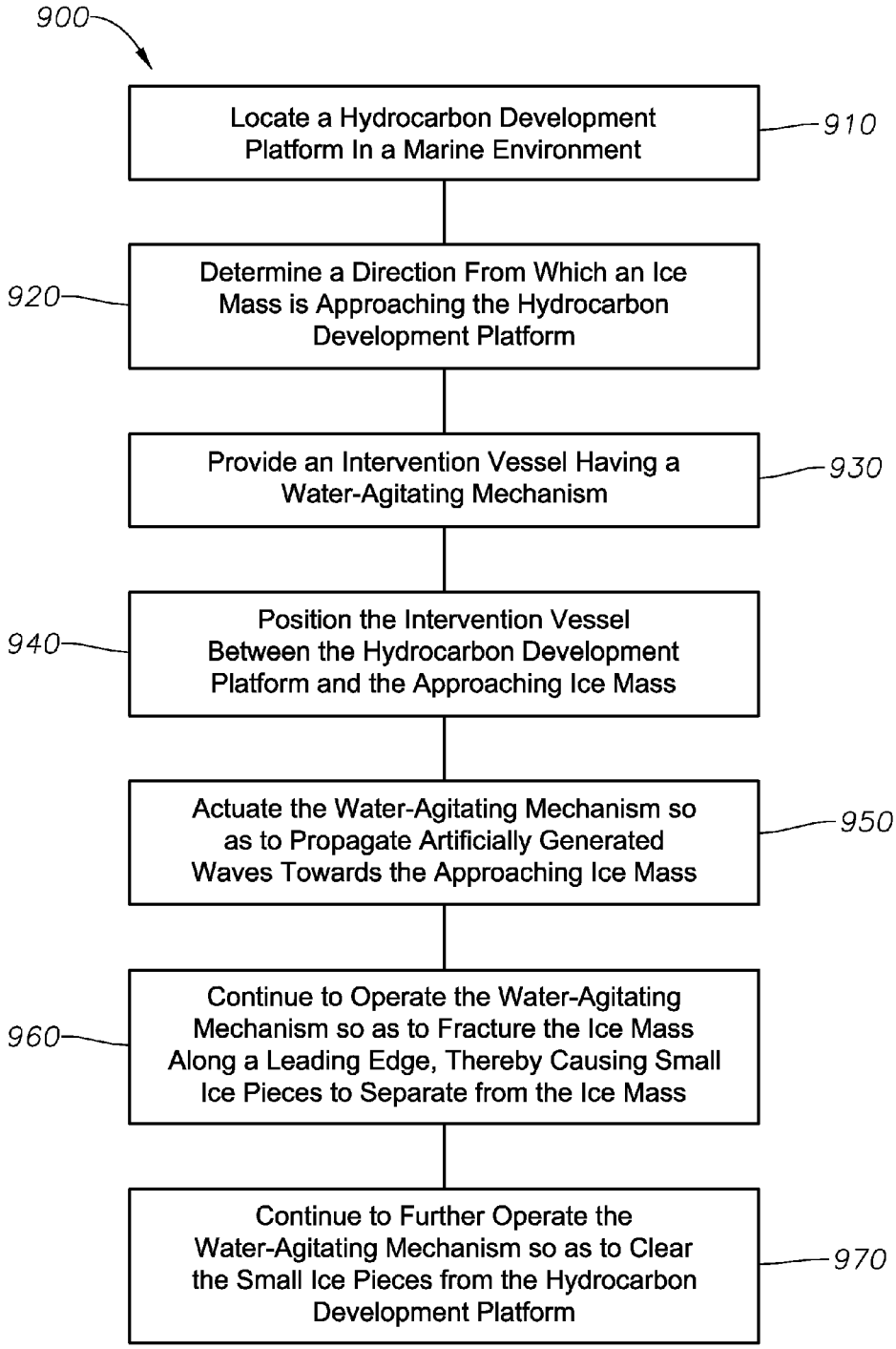
FIG. 9 is a flowchart showing steps for clearing an approaching floating ice mass, in one embodiment.

FIG. 9 is a flowchart showing steps for a method 900 for clearing an approaching floating ice mass, in one embodiment. The method 900 first includes the step of locating a hydrocarbon development platform in a marine environment. This step is shown at Box 910. The hydrocarbon development platform may be a drill ship or a ship-shaped production platform. Alternatively, the hydrocarbon development platform may be a non-ship-shaped floating platform such as a workover platform, a floating production, storage and offloading ("FPSO") vessel, an offshore workboat, a catenary anchor leg mooring ("CALM") buoy, or an oceanographic survey vessel.

The hydrocarbon development platform is maintained at its location in the marine environment by a dynamic positioning system. Alternatively, a mooring system may be employed. The marine environment comprises a large body of water. The body of water includes a water surface. The marine environment may be a bay, a sea, a channel, or an ocean in the Arctic region of the earth.

The method 900 also includes determining a direction from which the ice mass is approaching the hydrocarbon development platform. This is represented at Box 920. In one aspect, the floating ice mass is moving towards the hydrocarbon development platform at a speed of less than 1 meter per second. However some ice floes may travel at a faster rate.

The method 900 further includes providing an intervention vessel. This step is indicated at Box 930. The intervention vessel is preferably a ship-shaped vessel having a deck and a hull. Preferably, the intervention vessel is equipped with ice-breaking capability.

The intervention vessel has a water-agitating mechanism carried thereon. Various types of water-agitating mechanisms may be employed, as discussed above. For example, the water-agitating mechanism may comprise a gyroscopic system attached to the hull of the intervention vessel. The gyroscopic system may comprise a large spinning mass, a controller, and at least one gear for moving the large spinning mass so as to cause forced precession. The controller reciprocates the large spinning mass according to a specified frequency and amplitude. The large spinning mass is reciprocated in a direction to cause the intervention vessel to pitch, to roll, or combinations thereof.

In another embodiment, the water-agitating mechanism comprises a plurality of air guns. The air guns are disposed below the surface of the marine environment in the body of water. The plurality of air guns may be fired substantially simultaneously at a frequency of about two seconds to five seconds (0.5 Hz to 0.2 Hz).

In another embodiment, the water-agitating mechanism comprises a plurality of paddles. The paddles rotate through the surface of the marine environment and into the body of water. The plurality of paddles may rotate substantially simultaneously at a frequency of about three to five seconds (0.33 Hz to 0.2 Hz).

In another embodiment, the water-agitating mechanism comprises at least one pair of offsetting propulsion motors. The propulsion motors operate below the surface of the marine environment and in the body of water. In one aspect, the at least one pair of offsetting propulsion motors are simultaneously started and stopped in cycles to create waves having well-defined peaks and troughs. The cycles may be, for example, every two to ten seconds (0.5 Hz to 0.1 Hz).

In another embodiment, the water-agitating mechanism comprises a plurality of plungers that reciprocate in the body of water. In one aspect, the plurality of plungers reciprocate substantially simultaneously.

In one arrangement, the plurality of plungers may reciprocate vertically according to a stroke that is about 5 to 20 feet. In this instance, the frequency of the strokes may be about every three to ten seconds (0.33 Hz to 0.1 Hz). Here, the top of the stroke is at or above the surface of the body of water, while the bottom of the stroke is below the surface of the body of water.

In another arrangement, the plurality of plungers may reciprocate according to a stroke that is about 1 to 5 feet. This is a much shorter stroke such that the plunger is in the nature of a resonance vibrator. In this instance, the frequency of the strokes is about 0.1 to 2.0 seconds (10.0 Hz to 0.5 Hz). Here, both the top and the bottom of each stroke is below the surface of the body of water. The strokes may be vertical or lateral.

The method 900 for clearing an approaching floating ice mass also includes positioning the intervention vessel generally between the hydrocarbon development platform and the approaching ice mass. This step is provided at Box 940. The method 900 then includes actuating the water-agitating mechanism in order to propagate artificially generated waves. This step is provided at Box 950. The waves travel towards a leading edge of the approaching ice mass. In one aspect, the artificially generated waves have an amplitude of about two feet to five feet.

The method 900 also includes continuing to operate the water-agitating mechanism so as to fracture the ice mass along the leading edge. This step is provided at Box 960. This causes small ice pieces to separate from the ice mass. The small ice pieces then float in the marine environment, with some tending to float towards the hydrocarbon development platform.

The method 900 next includes continuing to further operate the water-agitating mechanism. This is shown at Box 970. This is for the purpose of clearing at least some of the small ice pieces from the hydrocarbon development platform. This results in a substantially ice-free zone downstream of the intervention vessel. This, in turn, allows the hydrocarbon development platform to operate without worry of ice mass collisions or unwanted ice loads.

The method 900 protects a relatively stationary hydrocarbon development platform and utilizes the natural ice drift to break up ice using the water-agitating mechanism and then carry small ice pieces around and beyond the hydrocarbon development platform.

While it will be apparent that the inventions herein described are well calculated to achieve the benefits and advantages set forth above, it will be appreciated that the inventions are susceptible to modification, variation and change without departing from the spirit thereof. For example, the methods and water-agitating mechanisms disclosed herein have utility for non-hydrocarbon producing operations. Item 120 may be, for example, an ice coring ship. The ice-management system could also be used to support iceberg management in pack ice by clearing a path for an iceberg towing vessel to tow the iceberg.

What is claimed is:

1. A method for clearing an approaching floating ice mass, comprising:

locating a hydrocarbon development platform in a marine environment, the marine environment comprising a large body of water and a water surface;

determining a direction from which the ice mass is approaching the hydrocarbon development platform;

providing an intervention vessel, the intervention vessel having a water-agitating mechanism associated therewith;

positioning the intervention vessel generally between the hydrocarbon development platform and the approaching ice mass;

actuating the water-agitating mechanism in order to propagate artificially generated waves towards a leading edge of the approaching ice mass; and continuing to operate the water-agitating mechanism so as to fracture the ice mass along the leading edge, causing small ice pieces to separate from the ice mass, wherein the marine environment is a bay, a sea or an ocean in the Arctic region of the earth, wherein the water-agitating mechanism is one or more gyroscopic systems attached to the intervention vessel.

2. The method of claim 1, wherein the hydrocarbon development platform is able to withstand a load caused by any impact with the small ice pieces separated from the ice mass.

3. The method of claim 1, further comprising:

continuing to further operate the water-agitating mechanism to substantially clear the small ice pieces from the hydrocarbon development platform while the hydrocarbon development platform is in a substantially stationary position.

4. The method of claim 1, wherein the hydrocarbon development platform is a drill ship, a ship-shaped production platform, a non-ship-shaped workover platform, a floating production, storage and offloading ("FPSO") vessel, an offshore workboat, a catenary anchor leg mooring ("CALM") buoy, a construction vessel as may be used to install subsea equipment or to lay pipe, a subsea cable installation vessel, a diver support vessel, an oil spill response vessel, a submarine rescue vessel, or an oceanographic survey vessel.

5. The method of claim 1, wherein the hydrocarbon development platform is maintained at its location by either a dynamic positioning system or by mooring.

6. The method of claim 5, wherein the artificially generated waves produce an amplitude of about two feet to five feet.

7. The method of claim 1, wherein:

the one or more gyroscopic system comprises a large spinning mass, a controller, and at least one gear for moving the large spinning mass so as to cause forced precession; and the controller sends a signal to the at least one gear to reciprocate the large spinning mass according to a specified frequency and amplitude.

8. The method of claim 7, wherein the large spinning mass is reciprocated to cause the intervention vessel to pitch, to roll, or combinations thereof.

9. The method of claim 1, wherein:

the intervention vessel is a ship-shaped vessel having a deck and a hull; and the one or more gyroscopic system is attached to the hull of the ship-shaped vessel.

10. The method of claim 1, wherein:

the intervention vessel comprises a first moored buoy; and the one or more gyroscopic system is attached to the first moored buoy.

11. The method of claim 10, further comprising:

positioning second moored buoys on substantially opposite sides of the first moored buoy, each of the second moored buoys also having the one or more gyroscopic system; and actuating the one or more gyroscopic systems on the second moored buoys to further propagate artificially generated waves towards a leading edge of the approaching ice mass.

* * * * *